US008179044B2

(12) United States Patent
Yoo et al.

(10) Patent No.: US 8,179,044 B2
(45) Date of Patent: May 15, 2012

(54) PLASMA DISPLAY DEVICE AND FABRICATING METHOD FOR THE SAME

(75) Inventors: Younggil Yoo, Suwon-si (KR); Kyeongwoon Chung, Suwon-Si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 0 days.

(21) Appl. No.: 12/698,494

(22) Filed: Feb. 2, 2010

(65) Prior Publication Data

US 2011/0187263 A1 Aug. 4, 2011

(51) Int. Cl.
*H01J 17/49* (2006.01)

(52) U.S. Cl. ..... 313/587; 313/586; 445/24; 445/25

(58) Field of Classification Search ..... 313/582–587; 445/24, 25

See application file for complete search history.

(56) References Cited

U.S. PATENT DOCUMENTS

| | | | | |
|---|---|---|---|---|
| 4,257,798 | A * | 3/1981 | Hendricks et al. | 65/21.4 |
| 6,603,260 | B1 * | 8/2003 | Kim et al. | 313/562 |
| 2003/0057831 | A1 * | 3/2003 | Nakayama et al. | 313/582 |
| 2004/0099844 | A1 | 5/2004 | Ravilisetty | |
| 2005/0062418 | A1 | 3/2005 | Kang et al. | |
| 2007/0007876 | A1 * | 1/2007 | Chung et al. | 313/486 |
| 2007/0057636 | A1 * | 3/2007 | Kim | 313/582 |
| 2007/0103058 | A1 | 5/2007 | Yoo | |

FOREIGN PATENT DOCUMENTS

| | | |
|---|---|---|
| JP | 01-225926 | 9/1989 |
| JP | 2000-306664 | 11/2000 |
| JP | 2002-358877 | 12/2002 |
| KR | 1020010077792 A | 8/2001 |
| KR | 10-2004-0043085 | 5/2004 |
| KR | 1020070005392 A | 1/2007 |

OTHER PUBLICATIONS

European Search Report, dated Jan 5, 2011, corresponding to European Patent Application No. 10190504.0, 9pgs.
Machine translation of JP 2000-306664, 8 pgs.
Machine translation of JP 2002-358877, 6 pgs.
Dong et al., New fast-decaying green and red phosphors for 3D application of plasma display panels, Journal of Luminescence, vol. 129 (2009), pp. 1088-1093.
Liang et al, The optical spectroscopic properties of rare earth-activated barium orthophosphate in VUV-Vis range, Science Direct Materials Research Bulletin, vol. 38 (2003) pp. 797-805.
KIPO Office Action dated Jul. 5, 2011 for corresponding Korean Patent application 10-2010-0063888, noting the listed reference in this IDS, 4 pages.

* cited by examiner

*Primary Examiner* — Bumsuk Won
(74) *Attorney, Agent, or Firm* — Christie, Parker & Hale, LLP

(57) ABSTRACT

A plasma display device with lowered discharge voltage by mixing activated carbon with phosphor layers and/or barrier ribs to produce carbon dioxide. The plasma display device includes a first substrate and a second substrate spaced from the first substrate, wherein the first substrate and the second substrate are sealed together. A plurality of barrier ribs are on the first substrate for defining a plurality of discharge cells between the first substrate and the second substrate. A phosphor layer is in the plurality of discharge cells, and a gas mixture including carbon dioxide is between the first and second substrates, wherein at least one of the phosphor layer or the plurality of barrier ribs includes an activated carbon.

13 Claims, 9 Drawing Sheets

PLASMA DISPLAY DEVICE AND FABRICATING METHOD FOR THE SAME

BACKGROUND

1. Field

An aspect of the present invention relates to a plasma display device and a fabricating method for the same.

2. Description of Related Art

A plasma display device is a flat panel display that displays an image using discharge of gas, and has excellent display quality in the aspects of display capacity, brightness, contrast, residual image, viewing angle, thinness, and large screen size.

However, since it is difficult to drive the plasma display device at a low voltage due to differences in surface voltages and discharge voltages caused by the compositions of phosphoric bodies, power consumption becomes higher.

In order to solve the above-mentioned disadvantages, a method of increasing the quantity of xenon (Xe) or mixing helium (He) as a Penning gas mixture in a plasma display device has been suggested. However, as the quantity of xenon (Xe) or helium (He) becomes higher, discharge voltages between electrodes also increase, making it difficult to increase the quantity of xenon (Xe).

SUMMARY OF THE INVENTION

The present invention has been made in view of the above problems, and the present invention provides a plasma display device that can reduce power consumption by being driven at a low voltage, thereby enhancing discharge efficiency and a fabricating method for the same.

According to an embodiment of the present invention, a plasma display device includes: a first substrate and a second substrate spaced from the first substrate, wherein the first substrate and the second substrate are sealed together. A plurality of barrier ribs are provided on a side of the first substrate facing the second substrate, and for defining a plurality of discharge cells between the first substrate and the second substrate. Further, a phosphor layer is in the plurality of discharge cells, and a gas mixture including carbon dioxide between the first and second substrates. At least one of the phosphor layer or the plurality of barrier ribs includes an activated carbon.

At least one of the first substrate or the second substrate may include a glass frit including the activated carbon. The gas mixture may include at least 10% xenon gas. The phosphor layer may include a mixture of phosphor and the activated carbon. The plurality of barrier ribs may include the activated carbon.

According to another embodiment of the present invention, a method is provided for fabricating a plasma display device including a first substrate and a second substrate spaced from the first substrate. The method includes: forming a plurality of barrier ribs on a side of the first substrate facing the second substrate, the barrier ribs for defining a plurality of discharge cells between the first substrate and the second substrate; forming a phosphor layer in the plurality of discharge cells, wherein at least one of the plurality of barrier ribs or the phosphor layer includes an activated carbon; and sealing a gas mixture including carbon dioxide between the first substrate and the second substrate. The carbon dioxide is generated from the activated carbon.

The carbon dioxide may be generated from the activated carbon in a thermal process and/or an aging process. The thermal process may include sealing the first substrate and the second substrate together.

The method may further include forming electrodes on the first substrate and the second substrate and applying voltages to the electrodes to remove impurities of the plasma display device. At least one of the first substrate or the second substrate may include a glass frit including the activated carbon. The gas mixture may include at least 10% xenon gas. The phosphor layer may include a mixture of phosphor and the activated carbon. The plurality of barrier ribs may include the activated carbon.

Accordingly, in a plasma display device according to the embodiments of the present invention, discharge voltage can be lowered and power consumption can be reduced by mixing activated carbon in phosphor layers to produce carbon dioxide in a discharge space in a thermal process such as a sealing/exhausting process or an aging process.

Further, in a plasma display device according to the embodiments of the present invention, discharge efficiency can be increased by increasing the quantity of injected xenon (Xe) while maintaining the same discharge voltage as a conventional one.

Furthermore, in a plasma display device according to the embodiments of the present invention, discharge voltage can be lowered and the life spans of electrodes can be extended by mixing activated carbon in barrier ribs to absorb impurities of a protection layer in an aging process.

BRIEF DESCRIPTION OF THE DRAWINGS

The features and aspects of embodiments of the present invention will be more apparent from the following detailed description in conjunction with the accompanying drawings, in which.

DETAILED DESCRIPTION

Figure 1:
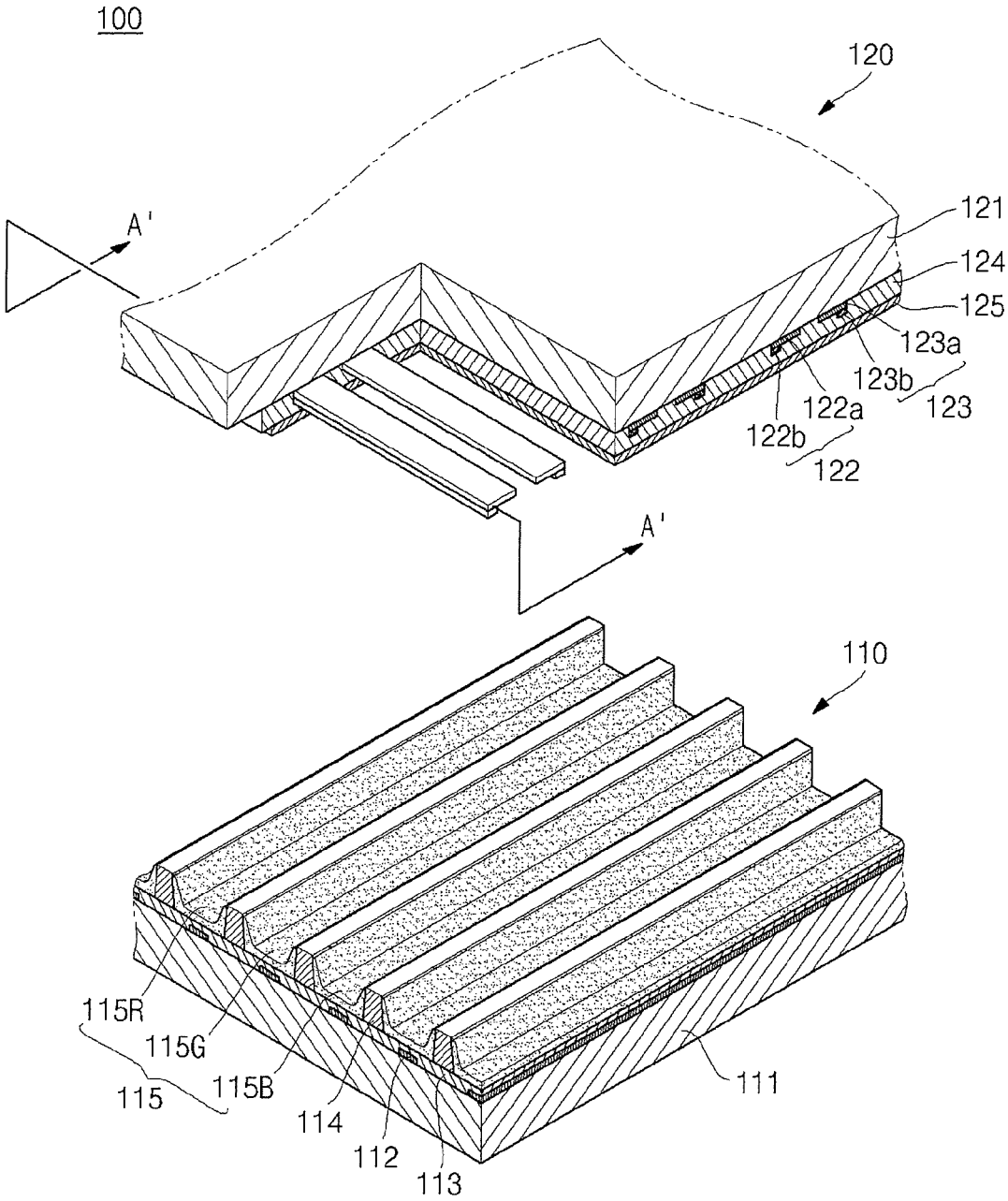
FIG. 1 is a perspective view illustrating a plasma display device according to an embodiment of the present invention.

Hereinafter, exemplary embodiments of the present invention will be described in detail with reference to the accompanying drawings so that those skilled in the art can carry out the invention. Here, when a first element is described as being coupled or connected to a second element, the first element may be directly coupled to the second element or indirectly coupled to the second element via a third element. Further, some of the elements of the embodiments that are not essential to a complete understanding of the present invention are omitted for clarity. Also, like reference numerals refer to like elements throughout the specification.

Hereinafter, a plasma display device 100 according to an embodiment of the present invention will be described in detail.

Figure 2:
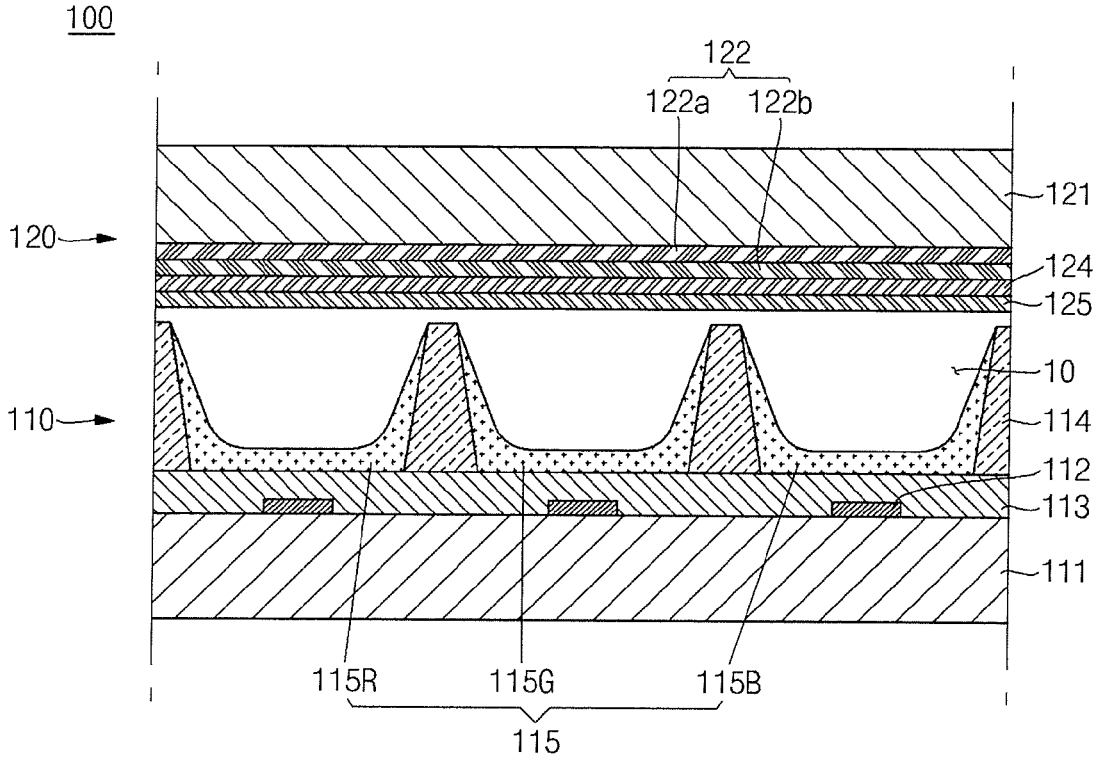
FIG. 2 is a sectional view of the plasma display device taken along the line A-A' of FIG. 1.

FIG. 1 is a perspective view illustrating the plasma display device 100 according to the embodiment of the present invention. FIG. 2 is a sectional view illustrating the plasma display device 100 taken along the line A-A' of FIG. 1.

Referring to FIGS. 1 and 2, the plasma display device 100 according to one embodiment of the present invention includes a first panel 110 and a second panel 120.

The first panel 110 is provided on the rear side of the plasma display device 100 according to an embodiment of the present invention.

The first panel 110 includes a first substrate 111, address electrodes 112, a first dielectric layer 113 surrounding the address electrodes 112, barrier ribs 114 formed on the first dielectric layer 113, and phosphor layers 115 formed between the barrier ribs 114.

The first substrate 111 is made of glass used in a general plasma display device. A plurality of address electrodes 112 are formed on the first substrate 111 and have their lengths extending in a first direction. The plurality of address electrodes 112 are space apart from each other along a second direction perpendicular to the first direction, and may be made of a material such as chrome (Cr), copper (Cu), or silver (Ag).

The first dielectric layer 113 is formed on the first substrate 111 and covers the address electrodes 112. The first dielectric layer 113 prevents positive or negative ions from reaching the address electrodes 112 during discharge operation, thereby preventing damage to the address electrodes 112. The first dielectric layer 113 induces charges and accumulates wall charges. The first dielectric layer 113 may be made of a material such as lead oxide (PbO), boron oxide ($B_2O_3$), and silicon oxide ($SiO_2$).

The barrier ribs 114 maintain an interval between the first substrate 111 and the second substrate 121. The barrier ribs 114 partition the space between the first substrate 111 and the second substrate 121 to form discharge spaces 10 (shown in FIG. 2) over the first dielectric layer 113 on the first substrate 111. Although the barrier ribs 114 are illustrated as a stripe type in which their long side extends in the first direction, the present invention is not limited thereto. In other words, the barrier ribs 114 may be of a matrix type in which longitudinal barrier ribs of a first direction and transverse barrier ribs of a second direction are formed and may have a polygonal planar shape such as a hexagonal shape or an octagonal shape. In the illustrated stripe type, the barrier ribs 114 are formed to extend in the first direction and are spaced apart from each other along the second direction and in parallel to the address electrodes 112. The barrier ribs 114 may be made of a material such as lead oxide (PbO), boron oxide ($B_2O_3$), silicon oxide ($SiO_2$), or aluminum oxide ($Al_2O_3$), and potassium oxide ($K_2O$), barium oxide (BaO), or zinc oxide (ZnO) may be used as an additive.

The phosphor layers 115 are formed in regions defined by the first dielectric layer 113 and the barrier ribs 114. The phosphor layers 115 include red phosphor layers 115R, green phosphor layers 115G, and blue phosphor layers 115B in corresponding sub-pixels. The phosphor layers 115 absorb ultraviolet (UV) rays generated when discharge occurs between scan electrodes 122 and sustain electrodes 123 of the second substrate 121 and generate red, green, and blue visible rays in the sub-pixels to display an image.

The phosphor layer 115 is formed by mixing a general phosphor, an organic binder, and a composite solvent with activated carbon. The activated carbon formed inside the phosphor layer 115 is a porous carbon material having fine pores and has excellent absorption characteristics. Thus, the phosphor layer 115 can absorb the impurities in the panel. As a result, the phosphor layer 115 can lower the discharge voltage and extend the life span of the plasma display device 100 according to the above-described embodiment of the present invention. After the activated carbon is included in the phosphor layers 115, it produces carbon dioxide ($CO_2$) inside the discharge spaces 10 in a thermal process such as a sealing/exhausting process or an aging process. Hence, since carbon dioxide ($CO_2$) is introduced into the discharge spaces 10 containing xenon (Xe), helium (He), and neon (Ne), a discharge voltage in the discharge spaces 10 is reduced. Therefore, since the plasma display device can be driven at a low voltage, power consumption of the panel and the drive circuit included in the plasma display device can be reduced.

When xenon (Xe) is included in the discharge gas, as the quantity of xenon (Xe) increases, brightness, thus, efficiency increases but a discharge voltage also increases. Therefore, there is a difficulty in further increasing the quantity of xenon (Xe) over 10%. On the other hand, since the plasma display device 100 according to the embodiment of the present invention can be driven at a low voltage due to the presence of the carbon dioxide ($CO_2$) generated by the phosphor layer 115, the quantity of xenon (Xe) may be increased to more than 10 percent while maintaining the existing discharge voltage, thereby enhancing discharge efficiency. Furthermore, the xenon gas may be between 12% and 30% to the whole discharge gas. If the xenon gas exceeds 12%, the discharge efficiency may be enhanced. And, If the xenon gas is below 30%, the existing discharge voltage may be maintained.

The second panel 120 is sealed with the first panel 110 to provide the discharge spaces 10 between the second panel 120 and the first panel 110. The visible rays generated in the first panel 110 are emitted through the second panel 120 to display an image.

The second panel 120 includes a second substrate 121, scan electrodes 122 and sustain electrodes 123 formed under the second substrate 121, a second dielectric layer 124 surrounding the scan electrodes 122 and the sustain electrodes 123, and a protection layer 125 formed under the second dielectric layer 124.

The second substrate 121 is made of general glass like the first substrate 111. Pairs of scan electrodes 122 and sustain electrodes 123 are formed under the second substrate 121. Each scan electrode 122 includes a transparent electrode 122*a* and a bus electrode 122*b*, and each sustain electrode 123 includes a transparent electrode 123*a* and a bus electrode 123*b*.

Pairs of transparent electrodes 122*a* and 123*a* are formed to extend in the second direction, perpendicular to the first direction in which the address electrodes 112 extend, along the second substrate 121. The transparent electrodes 122*a* and 123*a* are made of a transparent conductive material such as indium-doped tin oxide (ITO) or antimony-doped tin oxide (ATO) so that visible rays can be transmitted therethrough.

The bus electrodes 122*b* and 123*b* are formed in parallel to and under the transparent electrodes 122*a* and 123*a*. The bus electrodes 122*b* and 123*b* are formed of a conductive material such as chrome (Cr), copper (Cu), or silver (Ag) to compensate for the low conductivity of the transparent electrodes 122*a* and 123*a*.

The second dielectric layer 124 is formed under the second substrate 121 and surrounds the scan electrodes 122 and the sustain electrodes 123. The second dielectric layer 124 prevents currents from flowing between the scan electrodes 122 and the sustain electrodes 123, and prevents positive ions and negative ions from colliding with and damaging the scan electrodes 122 and the sustain electrodes 123. The second dielectric layer 124 induces charges and accumulates wall charges. The second dielectric layer 124 may be made of a material such as phosphoric oxide (PbO), barium oxide ($B_2O_3$), or silicon oxide ($SiO_2$).

The protection layer 125 is formed under the second dielectric layer 124. The protection layer 125 helps to prevent lowering of the life spans of the scan electrodes 122 and the sustain electrodes 123 by protecting a surface of the second dielectric layer 124. The protection layer 125 facilitates discharge by enhancing emission of secondary electrons during discharge. The protection layer 125 requires properties such as a high transmission, an anti-sputtering property, a low discharge voltage, a wide memory margin, and a safety for drive voltage, and thus is generally made of magnesium oxide (MgO) according to an embodiment of the present invention.

Hereinafter, the operation and effect of the plasma display device 100 according to an embodiment of the present invention will be described in more detail.

Figure 3:
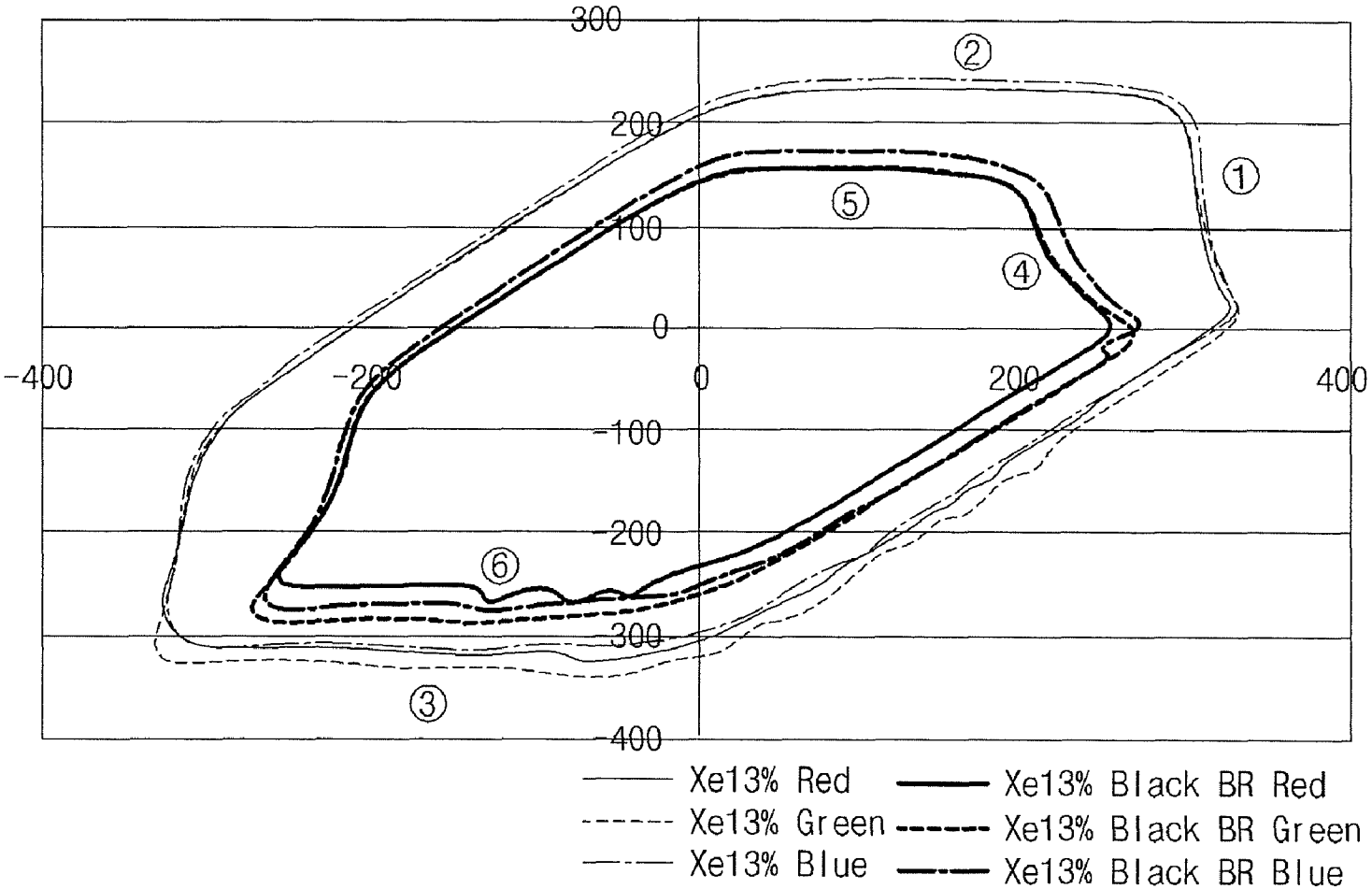
FIG. 3 is a graph illustrating discharge voltages between electrodes of the plasma display device of FIG. 1 according to an embodiment of the present invention.

FIG. 3 is a graph illustrating discharge voltages between electrodes of the plasma display device 100 according to the embodiment of the present invention.

The experiments for generating the graphs of the example in FIG. 3 were carried out using a discharge gas obtained by mixing 13 volumetric percent of xenon (Xe) and 51 volumetric percent of helium (He) to the volume of whole discharge gas. In the example of the plasma display device 100 according to an embodiment of the present invention, one volumetric percent of activated carbon was mixed in the blue phosphor layer 115B.

In FIG. 3, the graphs for a plasma display device of a comparative example are indicated by thin lines. In FIG. 3, the discharge voltages (Vf-XY) between the scan electrodes and the sustain electrodes are indicated by line 1, the discharge voltages (Vf-AY) between the address electrodes and the sustain electrodes are indicated by line 2, and the discharge voltages (Vf-YA) between the sustain electrodes and the address electrodes are indicated by line 3.

On the other hand, the graphs for the plasma display device 100 according to an embodiment of the present invention are indicated by dotted lines. In FIG. 3, the discharge voltages (Vf-XY) between the scan electrodes and the sustain electrodes are indicated by line 4, the discharge voltages (Vf-AY) between the address electrodes and the sustain electrodes are indicated by line 5, and the discharge voltages (Vf-YA) between the sustain electrodes and the address electrodes are indicated by line 6.

As illustrated in FIG. 3, the discharge voltage regions of the plasma display device 100 according to an embodiment of the present invention are formed within the discharge voltage regions of the comparative example of the plasma display device. In other words, it can be seen that the discharge voltages (lines 4, 5, and 6) between electrodes in the plasma display device 100 according to the embodiment of the present invention are decreased as compared with the discharge voltages (lines 1, 2, and 3) of the comparative example of the plasma display device.

The result of the graph is tabled as follows.

TABLE 1

| | Electrodes | Red | Green | Blue |
|---|---|---|---|---|
| Comparative Example | Vf-XY(1) | 311.6 | 314.2 | 313.9 |
| | Vf-AY(2) | 232.7 | 230.2 | 242.4 |
| | Vf-YA(3) | 318.9 | 336.7 | 321.4 |

| | Electrodes | Red | Difference | Green | Difference | Blue (1% of activated carbon) | Difference |
|---|---|---|---|---|---|---|---|
| Example | Vf-XY(4) | 245.5 | −66.1 | 244.8 | −69.4 | 248.3 | −65.5 |
| | Vf-AY(5) | 177.6 | −55.1 | 179.2 | −51.1 | 184.2 | −58.2 |
| | Vf-YA(6) | 270.7 | −48.2 | 302.7 | −34.0 | 259.7 | −61.7 |

Referring to FIG. 3 together with Table 1, it can be seen that the discharge voltages (Vf-XY) between the scan electrodes and the sustain electrodes are decreased by more than 65 V, the discharge voltages (Vf-AY) between the address electrodes and the sustain electrodes are decreased by more than 51 V, and the discharge voltages (Vf-YA) between the sustain electrodes and the address electrodes are decreased by 34 V as compared with the comparative example, even when one volumetric percent of activated carbon is mixed only in the blue phosphor layer 115B.

Since the discharge voltages (Vf-XY) between the scan electrodes and the sustain electrodes and the discharge voltages (Vf-AY) between the address electrodes and the sustain voltages determine a sustain voltage and the discharge voltages (Vf-YA) between the sustain electrodes and the address electrodes determines an address voltage, the plasma display device 100 according to the above described embodiment of the present invention can decrease the supply voltages of a sustain voltage source and an address voltage source. Therefore, the plasma display device 100 according to the embodiment of the present invention can have lower power consumption. In addition, discharge efficiency can be increased by increasing the quantity of xenon (Xe) and increasing the discharge voltages between electrodes to a conventional level.

As mentioned above, in the plasma display device according to the embodiment of the present invention, discharge voltage can be lowered and life span of the plasma display device can be extended by mixing activated carbon with the phosphor layers 115 to absorb impurities in the panel. And, the discharge voltage can be lowered and power consumption is reduced by producing carbon dioxide ($CO_2$) with the activated carbon in the discharge spaces 10 in a thermal process such as a sealing/exhausting process or an aging process. Moreover, discharge efficiency can be increased by increasing the quantity of xenon (Xe). In another embodiment of the present invention, activated carbon may be additionally mixed with the glass frit powder of the first substrate 111 or the second substrate 121, lowering discharge voltage more efficiently.

Hereinafter, a plasma display device 200 according to another embodiment of the present invention will be described in detail.

Figure 4:
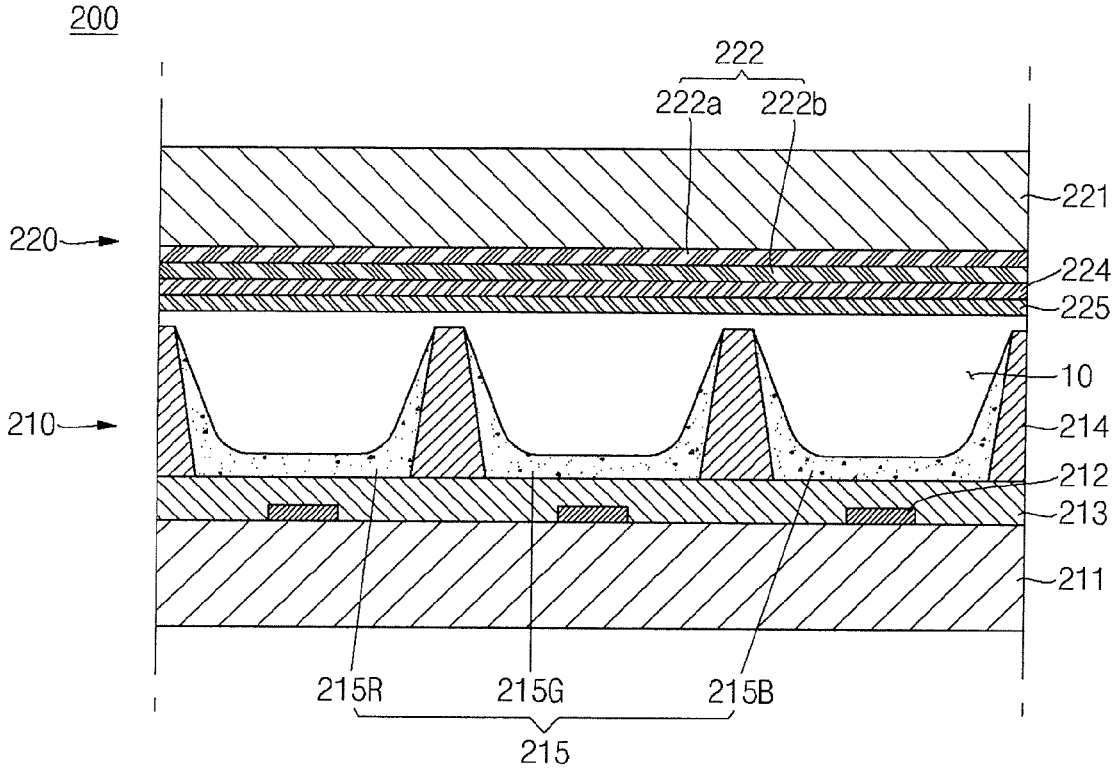
FIG. 4 is a sectional view illustrating a plasma display device according to another embodiment of the present invention.

FIG. 4 is a sectional view illustrating the plasma display device 200 according to another embodiment of the present invention. In the following description, the same or like elements are endowed with the same reference numerals, and differences from the prior embodiment of the present invention will be mainly described.

As illustrated in FIG. 4, the plasma display device 200 according to the embodiment of the present invention includes a first panel 210 and a second panel 220 formed over the first panel 210. The second panel 220 is the same as the second panel of FIG. 2.

The first panel 210 includes a first substrate 211, address electrodes 212, a first dielectric layer 213, barrier ribs 214 formed on the first dielectric layer 213, and phosphor layers 215 formed between the barrier ribs 214. The first substrate 211, the address electrodes 212, the first dielectric layer 213 are the same as corresponding components of the above-described embodiment of the present invention.

The barrier ribs 214 are formed on the first dielectric layer 213. The barrier ribs 214 are formed side by side and extending in a first direction in which the address electrodes 212 extend, and are spaced apart from each other in a second direction perpendicular to the first direction.

The barrier ribs 214 may be made of a material such as lead oxide (PbO), boron oxide ($B_2O_3$), silicon oxide ($SiO_2$), or aluminum oxide ($Al_2O_3$), and potassium oxide ($K_2O$), barium oxide (BaO), or zinc oxide (ZnO) may be used as an additive. The barrier ribs 214 contain activated carbon therein. Thus, the barrier ribs 214 can lower discharge voltage and extend life span of the plasma display device 200 according to an embodiment of the present invention.

The barrier ribs 214 generate carbon dioxide by a thermal process such as a sealing/exhausting process or an aging process. Therefore, as in the prior embodiment of the present invention, power consumption is reduced by reducing the discharge voltages between electrodes using the generated carbon dioxide. In addition, discharge efficiency can be enhanced by increasing the quantity of xenon (Xe).

The barrier ribs 214 absorb impurities existing in the protection layer 125 of the second panel 220 during the aging process. Therefore, the quality of the protection layer 225 can be improved by the barrier ribs 214, and thus discharge voltages between electrodes can be lowered further. As a result, the life spans of the scan electrodes 222, the sustain electrodes, and the protection layer 225 can be enhanced by improving the quality of the protection layer 225. In addition, the barrier ribs 214 are provided in a non-light emitting region to generate carbon dioxide during a thermal process or easily absorb impurities in the protection layer 225 during an aging process.

Here, unlike the prior embodiment of the present invention, the phosphor layer 215 is made of a general phosphor that does not contain activated carbon in sub-pixels 215R, 215G, and 2158. Therefore, the phosphor layer 215 of the plasma display device 200 according to the embodiment of the present invention can increase optical efficiency as compared with the prior embodiment of the present invention.

As mentioned above, in the plasma display device 200 according to the embodiment of the present invention, activated carbon is mixed in the barrier ribs 214 to produce carbon dioxide, in which case, power consumption is reduced and discharge efficiency can be enhanced when the quantity of xenon (Xe) is increased.

Hereinafter, a plasma display device 300 according to still another embodiment of the present invention will be described in detail.

Figure 5:
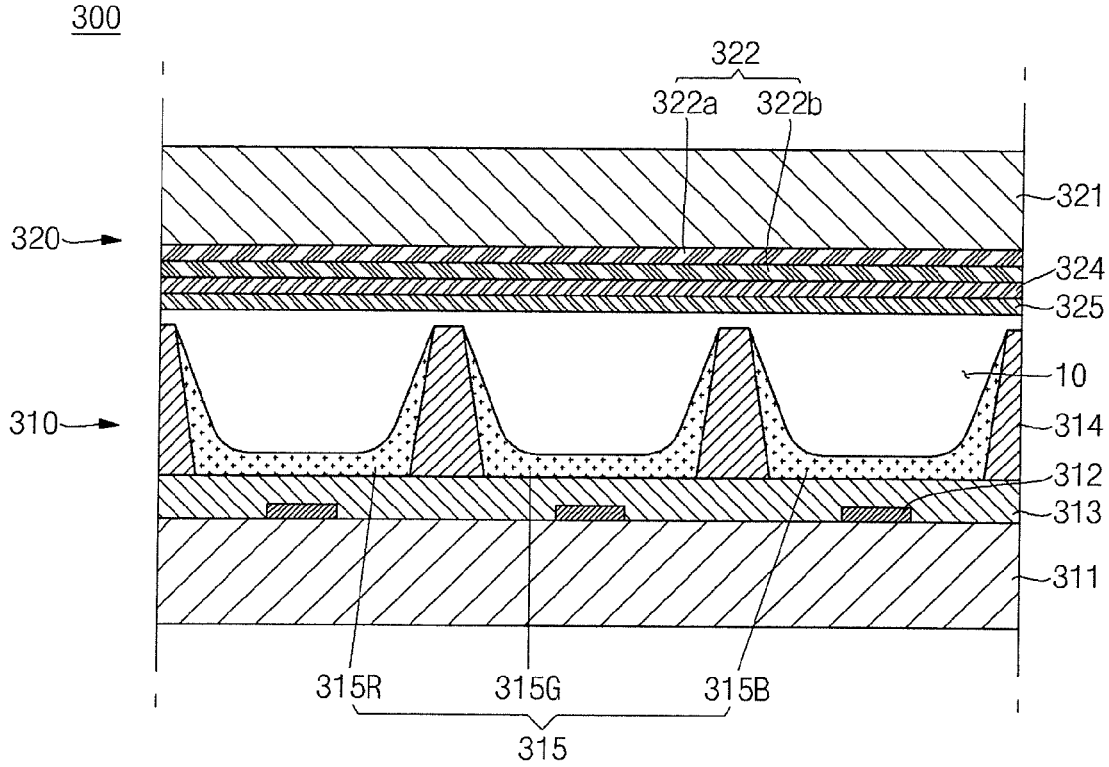
FIG. 5 is a sectional view illustrating a plasma display device according to still another embodiment of the present invention.

FIG. 5 is a sectional view of the plasma display device 300 according to still another embodiment of the present invention.

Referring to FIG. 5, the plasma display device 300 according to still another embodiment of the present invention includes a first panel 310, and a second panel 320 sealed over the first panel 310. The second panel 320 is the same as the second panel of the above-described embodiment of the present invention.

The first panel 310 includes a first substrate 311, address electrodes 312, a first dielectric layer 313, barrier ribs 314 formed on the dielectric layer 313, and phosphor layers 315 formed between the barrier ribs 314. The first substrate 311, the address electrode 312, the first dielectric layer 313 are the same as corresponding components of the above-described embodiment of the present invention.

The barrier ribs 314 and the phosphor layers 315 both contain activated carbon therein. Thus, the barrier ribs 314 and the phosphor layers 315 can lower discharge voltage and extend life span of the plasma display device 300 according to an embodiment of the present invention. And, the barrier ribs 314 and the phosphor layers 315 can produce carbon dioxide ($CO_2$) in a thermal process. As mentioned above, carbon dioxide lowers discharge voltage, reduces power consumption, and enhances discharge efficiency when the quantity of xenon (Xe) is increased.

Since the barrier ribs 314 and the phosphor layers 315 both contain activated carbon, more carbon dioxide is produced in a thermal process and thus discharge voltage can be lowered further. In addition, since the quality of the protection layer 325 is efficiently improved, discharge voltage can be lowered and the life spans of the scan electrodes 322 and the sustain electrodes 323 can be enhanced.

As mentioned above, in the plasma display device 300 according to still another embodiment of the present invention, activated carbon is mixed in the barrier ribs 314 and the phosphor layers 315 to reduce power consumption, enhance discharge efficiency, and increase the life spans of the scan electrodes 322 and the sustain electrodes 323. In one embodiment, It is also possible to further include at least one of dummy cell or non-discharge cell having barrier rib or phosphor layer having an activated carbon.

Hereinafter, a fabricating method for a plasma display device 100 according to an embodiment of the present invention will be described in detail.

Figure 6:
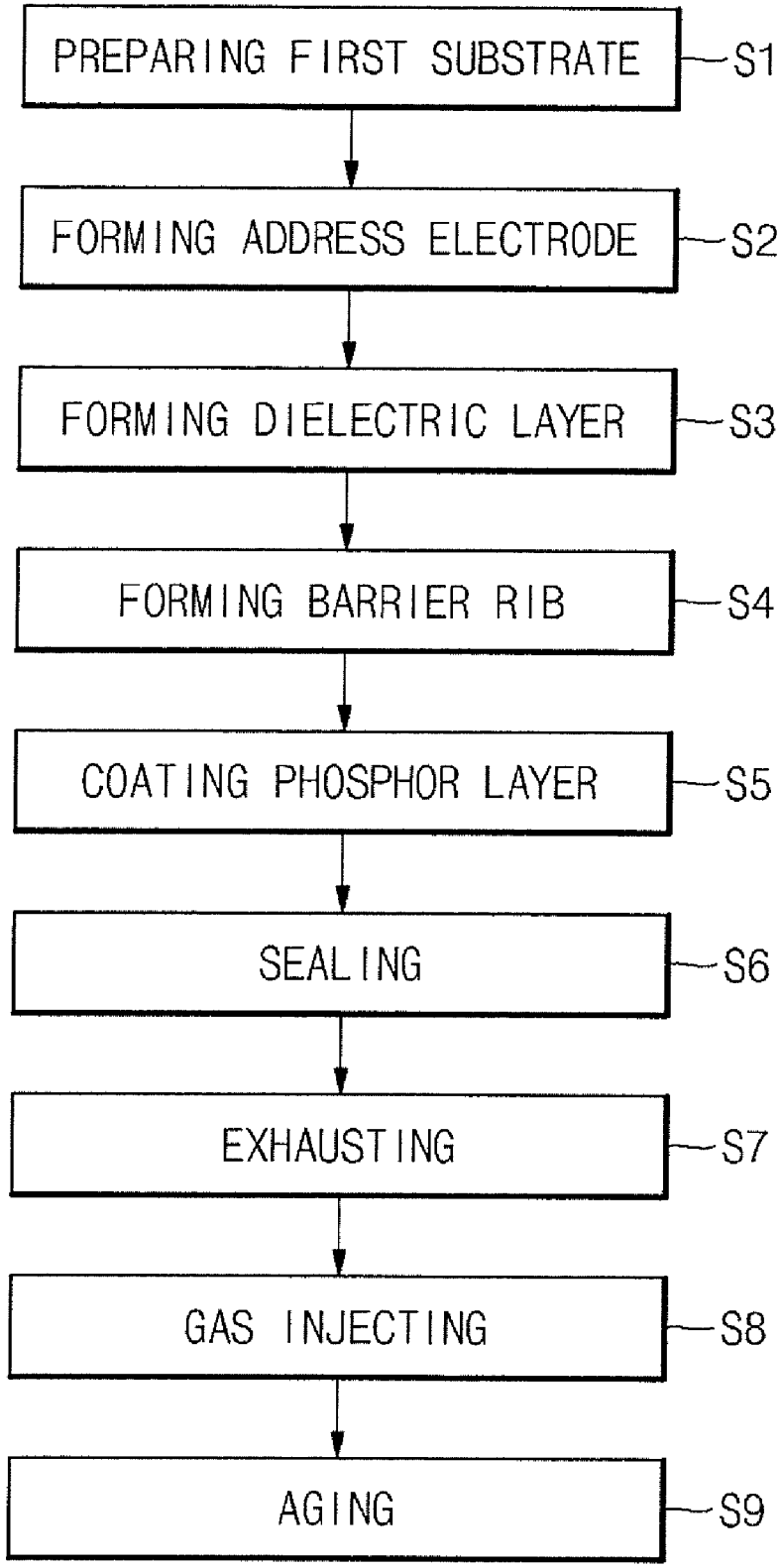
FIG. 6 is a flowchart illustrating a fabricating method for a plasma display device according to an embodiment of the present invention.

FIG. 6 is a flowchart illustrating a fabricating method for the plasma display device 100 according to an embodiment of the present invention. FIGS. 7A to 7F are sectional views illustrating the fabricating method for the plasma display device 100 according to an embodiment of the present invention.

Referring to FIG. 6, the fabricating method for the plasma display device 100 according to an embodiment of the present invention includes a first substrate preparing step S1, an address electrode preparing step S2, a dielectric layer forming step S3, a barrier rib (or partition wall) forming step S4, a phosphor coating step S5, a sealing step S6, an exhausting step S7, a gas injecting step S8, and an aging step S9. Hereinafter, the steps of FIG. 6 will be described in detail with reference to FIGS. 7A to 7F.

Figure 7A:
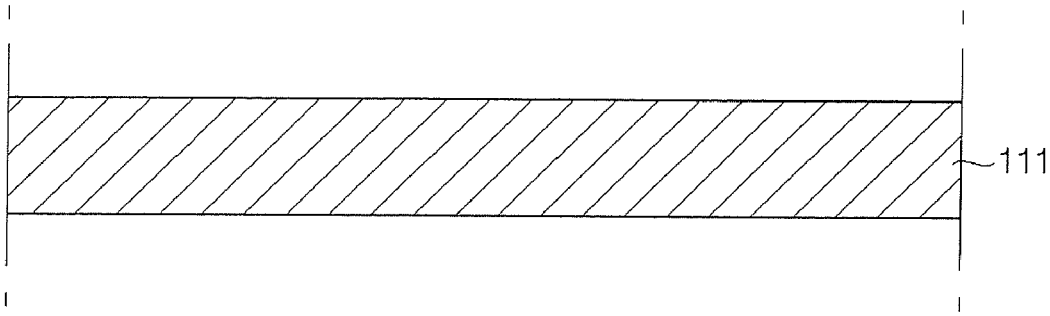
FIGS. 7A, 7B, 7C, 7D, 7E and 7F are sectional views illustrating the fabricating method for a plasma display device according to an embodiment of the present invention.

Referring to FIGS. 6 and 7A, in step S1, a first substrate 111 for forming a first panel is prepared. The first substrate 111 is made of general glass.

Figure 7B:
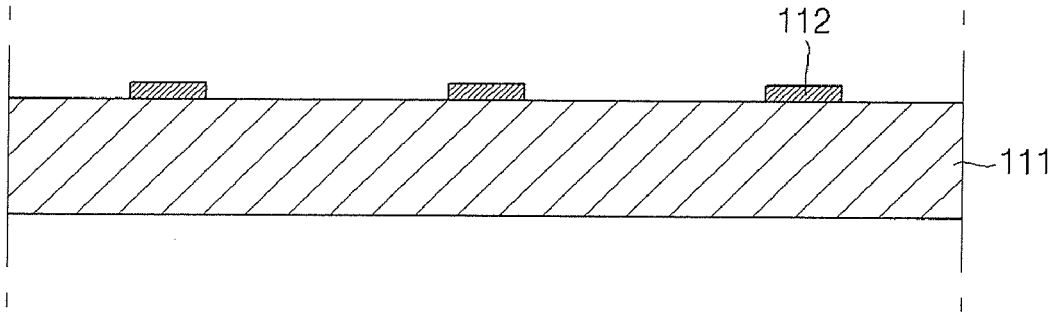

Referring to FIGS. 6 and 7B, in step S2, address electrodes 112 are formed on the first substrate 111. The address electrodes 112 are made of a material such as chrome (Cr), copper (Cu), and silver (Ag) using exposing or printing.

Figure 7C:
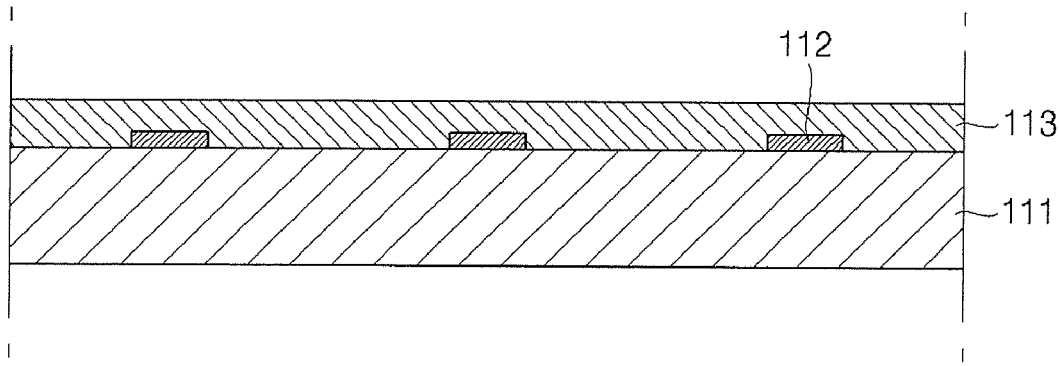

Referring to FIGS. 6 and 7C, in step S3, a first dielectric layer 113 is formed on the first substrate 111 and surrounds the address electrodes 112. The first dielectric layer 113 is made of a material such as lead oxide (PbO), boron oxide ($B_2O_3$), and silicon oxide ($SiO_2$) using printing, green sheeting, or table coating.

Figure 7D:
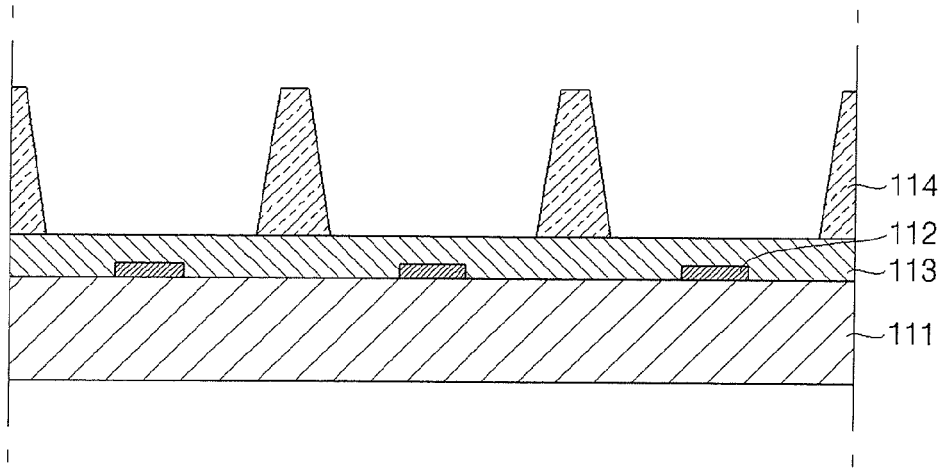

Referring to FIGS. 6 and 7D, in step S4, barrier ribs 114 are formed on the first dielectric layer 113. The barrier ribs 114 are made of a material such as lead oxide (PbO), boron oxide ($B_2O_3$), silicon oxide ($SiO_2$), and aluminum oxide ($Al_2O_3$). The barrier ribs 114 may be formed using printing, sand blasting, etching, lift-off, photosensitive paste, or molding.

Figure 7E:
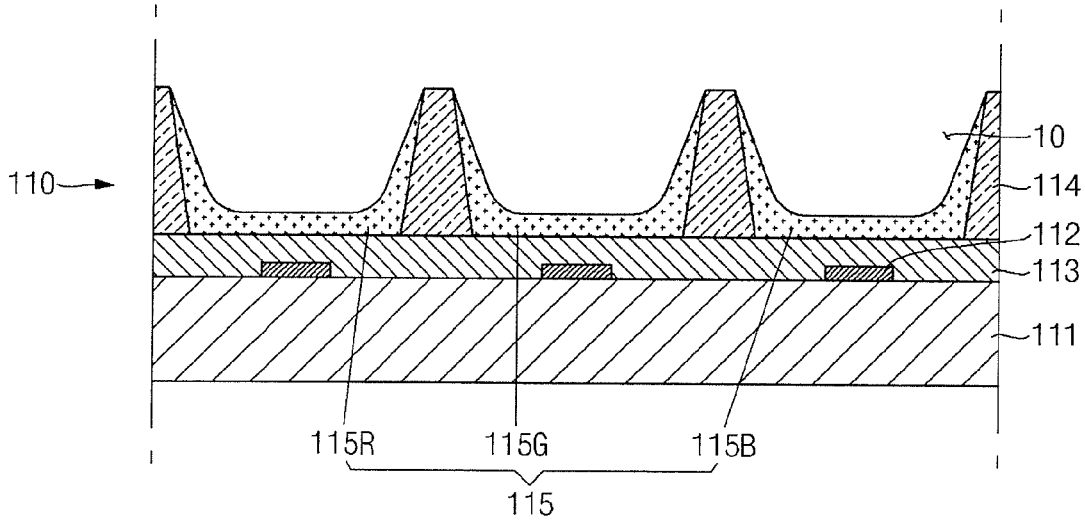

Referring FIGS. 6 and 7E, in step S5, phosphor layers 115 are coated in regions defined by the first dielectric layer 113 and the barrier ribs 114. The phosphor layers 115 are formed using paste obtained by mixing a general phosphor, an organic binder, and a solvent (e.g., BCA, TPN) with activated carbon. The phosphor layers 115 are formed by printing the paste using screen printing or inkjet printing. The first panel 110 is prepared by the above-mentioned steps.

Figure 7F:
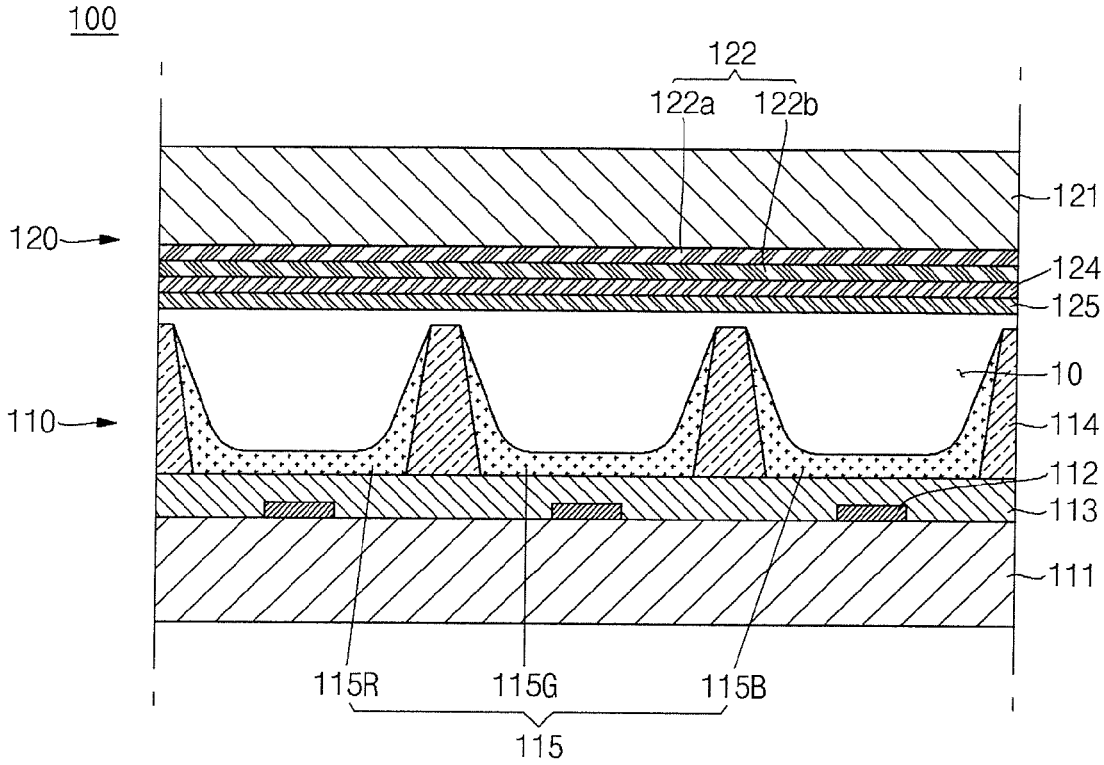

Referring to FIGS. 6 and 7F, in step S6, a second panel 120 is sealed over the first panel 110. The second panel 120 is sealed with the first panel 110, and discharge spaces 10 divided by the barrier ribs 114 are formed between the first panel 110 and the second panel 120. The shape of the plasma display device 100 is formed after step S6.

Referring to FIG. 6, in step S7, gas is exhausted from the plasma display device 100. Since the plasma display device 100 is heated while gas is being exhausted in step S6, carbon dioxide ($CO_2$) is produced from the activated carbon of the phosphor layers 115 while the gas is exhausted. And, the phosphor layer 115 can lower discharge voltage and extend life span of the plasma display device 100 according the above-described embodiment of the present invention.

Referring to FIG. 6, in step S8, discharge gas is injected into the plasma display device 100. The discharge gas is generally, but not limited to, xenon (Xe), helium (He) or neon (Ne). The carbon dioxide ($CO_2$) produced in step S6 is mixed with the discharge gas, thereby lowering discharge voltages between electrodes.

Referring to FIG. 6, in step S9, impurities of the plasma display device 100 are removed and the operation characteristics of the plasma display device 100 are stabilized by applying currents to the address electrodes 112, the scan electrodes 122, and the sustain electrodes 123 of the plasma display device 100. In step S9, carbon dioxide can be additionally produced from the activated carbon of the phosphor layer 115. Therefore, the discharge voltages between the electrodes can be lowered as mentioned above. Thereafter, an additional step of forming a drive circuit may be further performed.

The plasma display device 100 according to the above described embodiment of the present invention may be formed as in the above-mentioned way. Although not illustrated, the plasma display device 200 according to another embodiment of the present invention may use a mixture of carbon dioxide during formation of the barrier ribs 214. Furthermore, in the plasma display device 300 according to still another embodiment of the present invention, activated carbon may be mixed in the barrier ribs 314 and phosphor layers 315.

Although the exemplary embodiments of the present invention have been described in detail hereinabove, it should be understood that many variations and modifications of the basic inventive concept herein described will still fall within the spirit and scope of the present invention as defined in the appended claims and their equivalents.

What is claimed is:

1. A plasma display device comprising:

a first substrate and a second substrate spaced from the first substrate, wherein the first substrate and the second substrate are sealed together;

a plurality of barrier ribs on a side of the first substrate facing the second substrate, and for defining a plurality of discharge cells between the first substrate and the second substrate;

a phosphor layer in the plurality of discharge cells; and a gas mixture comprising carbon dioxide between the first and second substrates, wherein the plurality of barrier ribs comprises activated carbon mixed therein.

2. The plasma display device of claim 1, wherein at least one of the first substrate or the second substrate comprises a glass frit and activated carbon mixed therewith.

3. The plasma display device of claim 1, wherein the gas mixture comprises at least 10% xenon gas.

4. The plasma display device of claim 1, wherein the gas mixture comprises between 12% and 30% xenon gas.

5. The plasma display device of claim 1, wherein the phosphor layer comprises a mixture of phosphor and activated carbon.

6. The plasma display device of claim 1, further comprising at least one of a dummy cell or a non-discharge cell, wherein the at least one of the dummy cell or the non-discharge cell is defined by at least one barrier rib of the plurality of barrier ribs and includes the phosphor layer therein, and wherein at least one of the at least one barrier rib or the phosphor layer comprises activated carbon.

7. A method for fabricating a plasma display device comprising a first substrate and a second substrate spaced from the first substrate, the method comprising:

forming a plurality of barrier ribs on a side of the first substrate facing the second substrate, the barrier ribs for defining a plurality of discharge cells between the first substrate and the second substrate, the barrier ribs comprising, activated carbon mixed therein;

forming a phosphor layer in the plurality of discharge cells; and sealing a gas mixture comprising carbon dioxide between the first substrate and the second substrate, wherein the carbon dioxide is generated from the activated carbon.

8. The method of claim 7, wherein the carbon dioxide is generated from the activated carbon in at least one of a thermal process or an aging process.

9. The method of claim 8, wherein the thermal process comprises sealing the first substrate and the second substrate together.

10. The method of claim 7, further comprising:

forming electrodes on the first substrate and the second substrate; and applying voltages to the electrodes to remove impurities of the plasma display device.

11. The method of claim 7, wherein at least one of the first substrate or the second substrate comprises a glass frit and activated carbon mixed therewith.

12. The method of claim 7, wherein the gas mixture comprises at least 10% xenon gas.

13. The method of claim 7, wherein the phosphor layer comprises a mixture of phosphor and activated carbon.

* * * * *